US005208602A

United States Patent [19]

Monser et al.

[11] Patent Number: 5,208,602

[45] Date of Patent: May 4, 1993

[54] CAVITY BACKED DIPOLE ANTENNA

[75] Inventors: George J. Monser, Las Vegas, Nev.; Steven J. Ball, Lompoc, Calif.

[73] Assignee: Raytheon Company, Lexington, Mass.

[21] Appl. No.: 891,904

[22] Filed: Jun. 1, 1992

Related U.S. Application Data

[63] Continuation of Ser. No. 700,348, May 7, 1991, abandoned, which is a continuation of Ser. No. 492,186, Mar. 12, 1990, abandoned.

[51] Int. Cl.[5] ..... H01Q 21/26

[52] U.S. Cl. ..... 343/795; 343/797; 343/807

[58] Field of Search ..... 343/795, 797, 789, 807

[56] References Cited

U.S. PATENT DOCUMENTS

| | | | |
|---|---|---|---|
| 2,547,416 | 12/1946 | Skellett | 343/753 |
| 3,192,531 | 6/1965 | Cox et al. | 343/895 |
| 3,686,674 | 8/1972 | Clasby et al. | 343/895 |
| 3,745,585 | 7/1973 | Barbano | 343/792.5 |
| 3,836,976 | 9/1974 | Monser et al. | 343/797 |
| 4,218,685 | 8/1980 | Ellis | 343/789 |
| 4,287,518 | 9/1981 | Ellis | 343/795 |
| 4,475,109 | 10/1984 | Dumas | 343/797 |
| 4,573,212 | 2/1986 | Lipsky | 343/895 |
| 4,608,572 | 8/1986 | Blakney et al. | 343/792.5 |
| 4,814,777 | 3/1989 | Monser | 343/727 |
| 4,819,004 | 4/1989 | Argintaru et al. | 343/789 |
| 4,888,597 | 12/1987 | Rebiez et al. | 343/789 |

FOREIGN PATENT DOCUMENTS

| | | | |
|---|---|---|---|
| 3215323 | 7/1983 | Fed. Rep. of Germany | 343/768 |

*Primary Examiner*—Michael C. Wimer

*Attorney, Agent, or Firm*—William R. Clark; R. M. Sharkansky

[57] ABSTRACT

A small volume, broad beam antenna is disclosed. The antenna has four cavity backed elements. Each of the elements is triangular shaped and is mounted such that the narrow portions of the triangular elements are over the center of the cavity.

15 Claims, 2 Drawing Sheets

CAVITY BACKED DIPOLE ANTENNA

This application is a continuation of application Ser. No. 700,348 filed May 7, 1991, now abandoned which is a continuation of application Ser. No. 492,186, filed Mar. 12, 1990, abandoned.

BACKGROUND OF THE INVENTION

This antenna relates generally to antennas for receiving or transmitting radio frequency energy and more particularly to broadband antennas which fit into relatively small volumes.

Antennas are widely used in many types of systems. The structure of the antenna affects its operating characteristics. As a result, antennas take on a variety of shapes. The particular shape is selected to meet the requirements of a system.

For certain systems, it is desirable to construct a broadband, circularly-polarized antenna which transmits or receives a beam of radio frequency energy over a wide angular range (i.e., a broad-beam antenna). The antenna must be relatively small and have a low manufacturing cost. Further, when many antennas are made, each should have substantially the same performance characteristics.

Crossed dipoles are often used to construct inexpensive broad beam antennas. Crossed dipoles are relatively broad beamed. In addition, the phase of signals applied to the different dipoles can be varied to produce signals with linear or circular polarizations.

One variation on the crossed dipole antenna is called a notch antenna. The four dipole halves are constructed from rectangular sheets of conducting material mounted perpendicular to a ground plane which acts as a reflector. The corner of each rectangular sheet near the center of the structure is cut out to form notches.

Such antennas, while adequate for some applications, did not provide adequate gain or bandwidth for some applications.

SUMMARY OF THE INVENTION

It is an object of this invention to provide an antenna which occupies a small volume.

It is also an object to provide an antenna which can transmit or receive circularly polarized signals over at least one frequency octave.

It is further an object of this invention to provide an antenna which transmits or receives signals over a wide range of angles.

The foregoing and other objects are achieved in a cavity backed antenna. The cavity is covered with a dielectric sheet to which are mounted four triangular pieces of conductive material. The triangular pieces are perpendicular to the dielectric sheet such that thin edges of the sheets face the cavity. The floor of the cavity contains strips of RF absorbing material in sufficient quantity to suppress the excitation of circular modes in the cavity.

BRIEF DESCRIPTION OF THE DRAWINGS

The invention may be better understood by reference to the following more detailed description and accompanying drawings in which.

DESCRIPTION OF THE PREFERRED EMBODIMENTS

Figure 1:
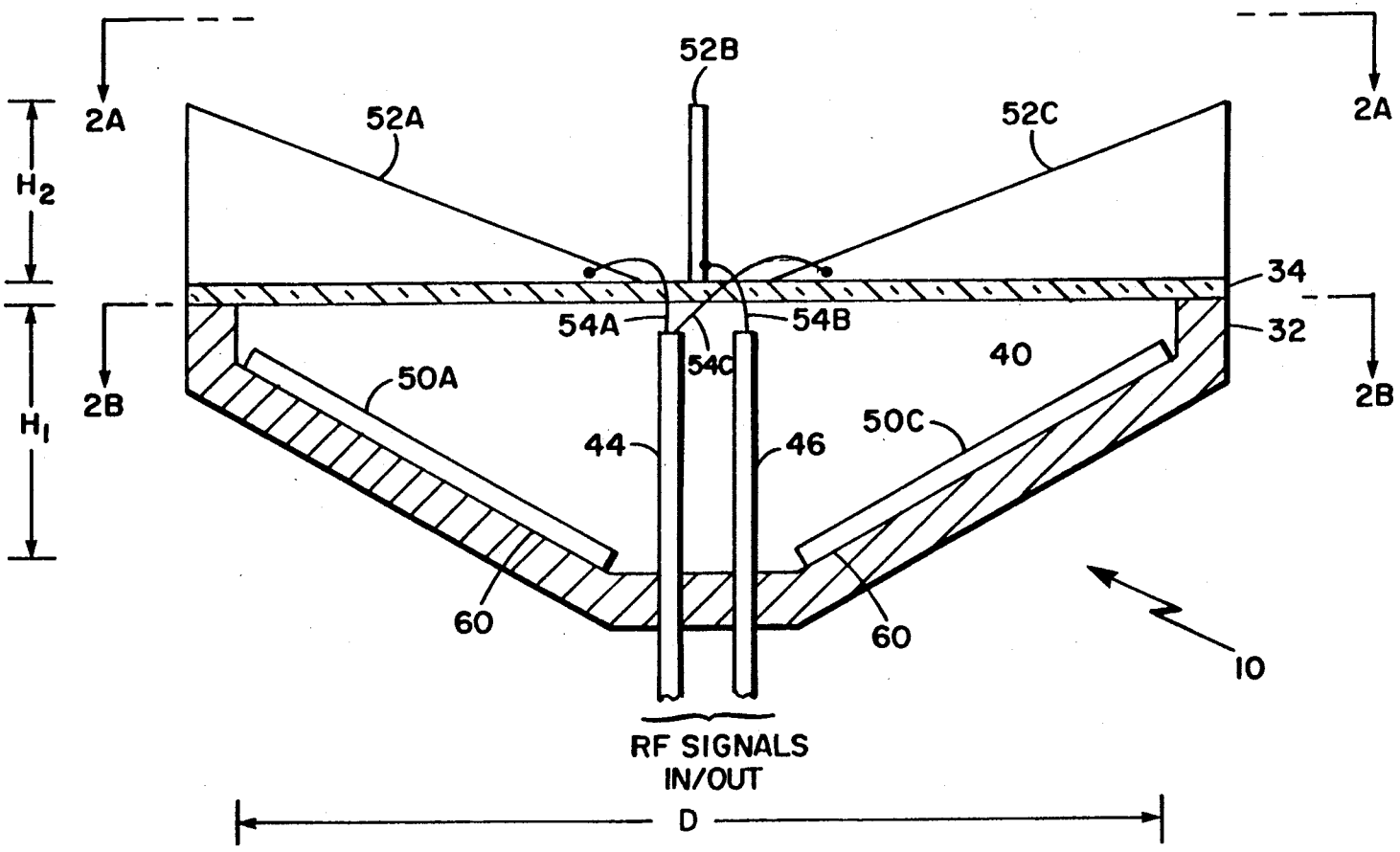
FIG. 1 is a simplified sketch of a cross-section of an antenna constructed according to the invention.

FIG. 1 shows a cross-section of an antenna 10 constructed in accordance with the invention. Known construction techniques and materials are used to fabricate antenna 10. A base 32 of conductive material is shaped to form a cavity 40.

A dielectric sheet 34 is mounted across cavity 40. Triangular shaped elements 52A . . . 52D (see also FIG. 2A) are mounted on dielectric sheet 34. Elements 52A . . . 52D are oriented so that they are orthogonal to dielectric sheet 34. Elements 52A . . . 52D have a height, $H_2$, roughly equal to one-quarter of a wavelength.

Posts 44 and 46 protrude through base 32 into cavity 40. Posts 44 and 46 are hollow and each encloses signal lines which feed two of the elements 52A . . . 52D.

Figure 2B:
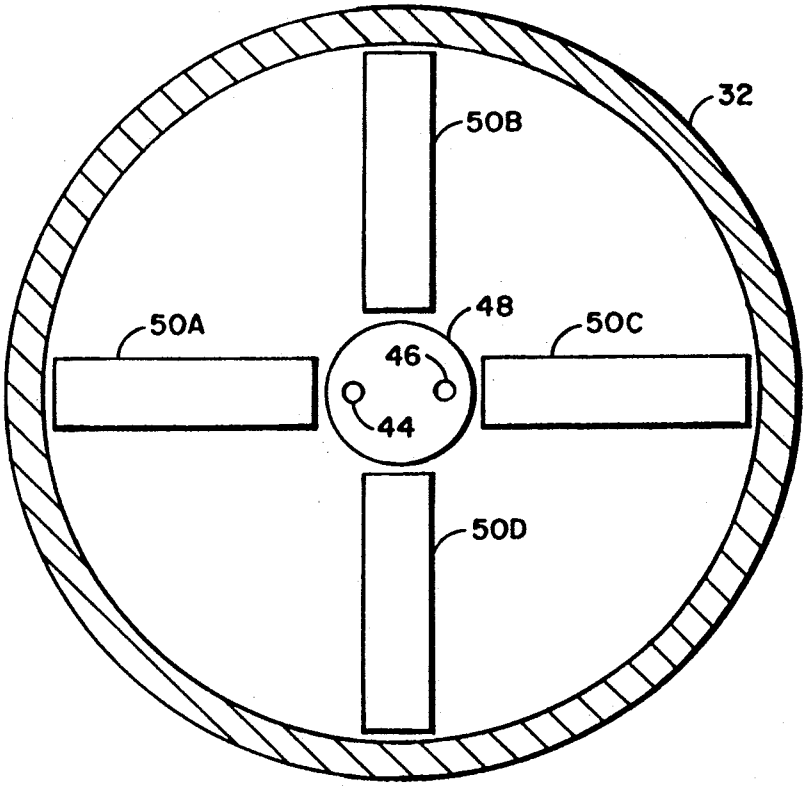
FIG. 2B is a top view of the antenna of FIG. 1 with dielectric sheet 34 removed.
Figure 2A:
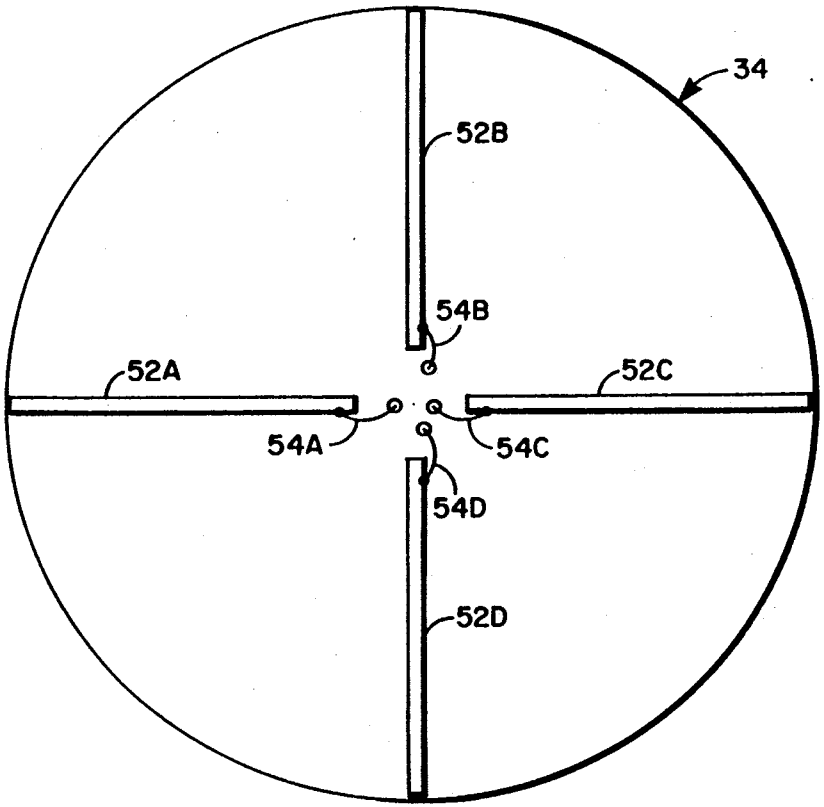
FIG. 2A is a top view of the antenna of FIG. 1.

FIG. 2A shows a top view of the antenna 10 as indicated by line 2—2. As seen more clearly in FIG. 2A, signal line 54A is coupled to element 52A. Signal lines 54B, 54C, and 54D are coupled to elements 52B, 52C, and 52D, respectively.

The pair of elements 52A and 52C can be though of as two halves making up a dipole. Thus, the signals on lines 54A and 54C will ordinarily be 180° out of phase. Likewise, the signals on lines 54B and 54D will be 180° out of phase. As in a conventional crossed dipole array, the relative phase of the signals at elements 52A and 52B will determine the polarization of the signals transmitted by antenna 10. (Throughout, antenna 10 will be referred to as transmitting signals. However, one of skill in the art will appreciate that antenna 10 is equally well adapted to receive signals.) As with a conventional antenna, the phase relationship between the various signals is maintained by the system in which the antenna is used.

The floor of cavity 40 has strips of RF absorbing material 50A . . . 50D (see also FIG. 2B) disposed over selected regions of it. FIG. 2B shows a top view of antenna 10 taken along line 2B—2B. As seen in FIG. 2B, absorber strips 50A . . . 50D occupy a relatively small area of the floor of cavity 40. For example, absorber strips 50A . . . 50D occupy less than 25% of the floor area of cavity 40. The amount of absorber material is selected to be enough to damp out any circular modes within cavity 40. However, if absorber strips 50A . . . 50D are too big, the gain of antenna 10 will decrease.

In operation, RF signals will radiate from elements 52A . . . 52D. These signals will form a beam, the boresight of which is orthogonal to dielectric sheet 34 in the direction away from cavity 40.

Of course, a portion of the transmitted RF signal will radiate into cavity 40. It should be noted that cavity 40 has a floor 60 which is tapered at an angle roughly equivalent to the angles used in corner reflectors. The signal energy transmitted into cavity 40 is thus reflected back into the direction of the boresight of the antenna. It should be noted that the triangular shape of elements 52A . . . 52D ensures that the volume occupied by elements 52A . . . 52D along the boresight of the antenna is relatively small. The elements 52A . . . 52D can thus be said not to "block" the reflected signal.

Also, the shape of antenna elements 52A . . . 52D ensures that the phase center of the radiator formed by the elements is near the upper surface of dielectric sheet 34. In prior art notch antennas, the phase center of the radiating elements was spaced away from a reflector. Thus, there was a significant distance between the phase center of the radiated signal and the reflected signal. This distance allowed destructive interference at certain frequencies, which tended to lower the bandwidth of the antenna. The present design does not suffer as much from such a problem.

To provide the appropriate reflection and to provide a small volume antenna, cavity 40 has height, $H_1$, approximately equal to ¼ of a wavelength and a diameter, D, approximately equal to ½ of a wavelength.

Having described one embodiment of the invention, it will be apparent to one of skill in the art that various modifications can be made to that structure. For example, signal lines 54A . . . 54D pass through cavity 40 inside posts 44 and 46. Signal lines might just as well be introduced from the sides of antenna 10 and the signal lines would then run across dielectric sheet 34. As another example, the antenna 10 has been described only as transmitting signals. Of course, antenna 10 works equally well to receive signals. It is felt, therefore, that this invention should be limited only by the spirit and scope of the appended claims.

What is claimed is:

1. An antenna comprising:

a) a base having a cavity formed therein;

b) a dielectric sheet having a first side and a second side mounted to the base over the cavity with the first side facing into the cavity and a second side out of the cavity; and c) a dipole comprising a pair of conductive elements mounted to the dielectric sheet, each such element comprising a sheet of conductive material mounted outside the cavity substantially orthogonal to the dielectric sheet, each of said conductive sheets having a first end over a first portion of the cavity and a second end over a second portion of the cavity, and a first edge joining the first and second ends, wherein the first edge is tapered with respect to the dielectric sheet, wherein radio frequency energy passes between said dipole and said cavity and is reflected by portions of walls of said cavity, said walls being disposed at an angle so that the depth of the cavity is greater in the center than at the edges.

2. The antenna of claim 1 wherein the first end has a height greater than the height of the second end and wherein the second end is closer to the center of the dielectric sheet than the first end.

3. The antenna of claim 2 wherein each conductive sheet forms a triangle with one edge along the dielectric sheet, one edge orthogonal to the dielectric sheet and a third edge of the conductive sheet forming the hypotenuse of the triangle.

4. The antenna of claim 1 additionally comprising a second pair of conductive elements orthogonally mounted to the dielectric sheet, each element of said second pair being mounted at substantially a right angle to one of the elements of the first pair of conductive elements.

5. The antenna of claim 2 additionally comprising a second pair of conductive elements orthogonally mounted to the dielectric sheet, each element of said second pair being mounted at substantially a right angle to one of the elements of the first pair of conductive elements.

6. The antenna of claim 3 additionally comprising a second pair of conductive elements orthogonally mounted to the dielectric sheet, each element of said second pair being mounted at substantially a right angle to one of the elements of the first pair of conductive elements.

7. An antenna comprising:

a) a base having a cavity formed therein;

b) a dielectric sheet having a first side and a second side mounted to the base over the cavity with the first side facing into the cavity and a second side out of the cavity;

c) a dipole comprising a pair of conductive elements mounted to the dielectric sheet, each such element comprising a sheet of conductive material mounted outside the cavity substantially orthogonal to the dielectric sheet, each of said conductive sheets having a first end over a first portion of the cavity, and a second end over a second portion of the cavity, and a first edge joining the first and second ends, wherein the first edge is tapered with respect to the dielectric sheet, wherein radio frequency energy passes between said dipole and said cavity; and wherein the cavity is deepest below the portions of the conductive elements where the tapered edges are closest to the dielectric sheet.

8. The antenna of claim 7 additionally comprising a post passing through the base into the cavity.

9. The antenna of claim 8 additionally comprising two signal lines disposed within the post, each of said signal lines connected to one of the pair of conductive elements.

10. An antenna comprising:

a) a dielectric sheet;

b) a pair of conductive elements mounted to the dielectric sheet, each such element comprising a sheet of conductive material mounted substantially orthogonal to the dielectric sheet, each of said conductive sheets having a first end and a second end, and a first edge joining the first and seconds ends, wherein the first edge is tapered with respect to the dielectric sheet;

c) a base having a cavity formed therein, said cavity having a floor and an opening and wherein the dielectric sheet extends across the opening of the cavity; and d) at least one strip of absorbing material mounted to the floor of the cavity.

11. The antenna of claim 10 wherein the at least one strip of absorbing material covers less than 25% of the floor of the cavity.

12. The antenna of claim 10 wherein the floor of the cavity has sections which slope such that the depth of the cavity is greater near the center than near the edges.

13. An antenna comprising:

a) a base having a cavity formed therein, said cavity having a floor and an opening and having center portions and end portions, the cavity being deeper at the center portions than the end portions;

b) a dielectric sheet mounted across the opening of the cavity; and c) four triangular conducting elements orthogonally mounted to the sheet outside of said cavity, said triangular conducting elements being mounted with a first edge adjacent to the dielectric sheet and a second edge terminating above the center portions of the cavity, wherein the distance between said first and second edges increases as the distance from the center portions of the cavity increases.

14. The antenna of claim 13 wherein each of the triangular conducting elements are mounted with a first apex having an angle less than 90° adjacent the dielectric surface.

15. The antenna of claim 13 wherein the four triangular conducting elements comprise a radiating element having a phase center substantially at a surface of the dielectric sheet.

* * * * *